US007218187B2

(12) United States Patent
Qi et al.

(10) Patent No.: US 7,218,187 B2
(45) Date of Patent: May 15, 2007

(54) BOW TIE COUPLER

(75) Inventors: Yihong Qi, Waterloo (CA); Perry Jarmuszewski, Waterloo (CA); Michael Certain, Kitchener (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

(21) Appl. No.: 11/416,440

(22) Filed: May 3, 2006

(65) Prior Publication Data

US 2006/0197628 A1 Sep. 7, 2006

Related U.S. Application Data

(63) Continuation of application No. 10/797,492, filed on Mar. 10, 2004.

(51) Int. Cl.
*H01P 5/12* (2006.01)
*H01Q 9/28* (2006.01)

(52) U.S. Cl. ..... 333/117; 333/24 R; 343/795

(58) Field of Classification Search ..... 333/116, 333/117, 118; 343/793, 795, 807, 822
See application file for complete search history.

(56) References Cited

U.S. PATENT DOCUMENTS

| | | | | |
|---|---|---|---|---|
| 4,356,492 | A | 10/1982 | Kaloi | |
| 4,955,085 | A * | 9/1990 | Woody | 455/330 |
| 5,293,175 | A | 3/1994 | Hemmie | |
| 5,914,497 | A | 6/1999 | Sherwin | |
| 5,914,695 | A | 6/1999 | Liu | |
| 6,265,977 | B1 | 7/2001 | Vega | |
| 6,281,843 | B1 | 8/2001 | Evtioushkine | |
| 6,307,525 | B1 | 10/2001 | Bateman | |
| 6,559,810 | B2 | 5/2003 | McCorkle | |
| 6,842,141 | B2 | 1/2005 | Suh | |

FOREIGN PATENT DOCUMENTS

JP 6-27170 A 4/1994

OTHER PUBLICATIONS

Qing Hu et al., "Millimeter wave superconducting receivers", IEEE MTT-S Microwave Symposium Digest, Boston, MA, Jun. 10, 1991, pp. 409-412.
Compton, R.C., et al., 'Bow-tie antennas on a dielectric half-space: theory and experiment', IEEE Trans. Antennas and Propagation, Jun. 1987, AP-35, (6), pp. 622-630.
Loi, K.W., et al., 'Novel design of a wide-band microstrip bowtie patch antenna', Proc. Inst. Elect. Eng., vol. 145 pt. H, pp. 137-140, Apr. 1998.
Wong, K.L., and Chen, W.S.: 'Slot-loaded bow-tie microstrip antenna for dual-frequency operation', Electronics Letters, vol. 34, No. 18, pp. 1713-1714, Sep. 1998.

* cited by examiner

*Primary Examiner*—Dean Takaoka
(74) *Attorney, Agent, or Firm*—Brenda Pomerance

(57) ABSTRACT

A wide bandwidth coupler has two outer elements around a center element. The outer elements are rectangular at their outside portions and each have a tapered nose portion next to the center element. A matching network electrically connects the two outer elements and the center element. The center element is connected to a first portion of a signal feed structure, while one of the outer elements connects to a second portion of a signal feed structure.

11 Claims, 8 Drawing Sheets

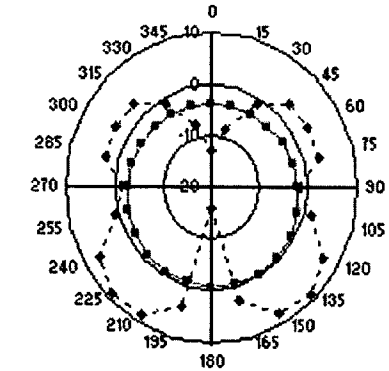
FIG. 3A
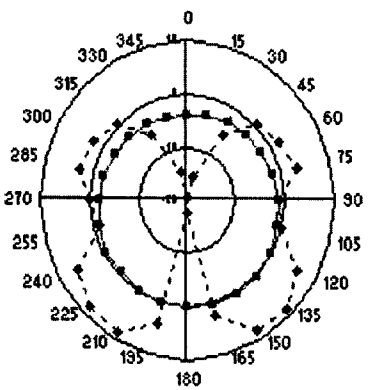
FIG. 3B
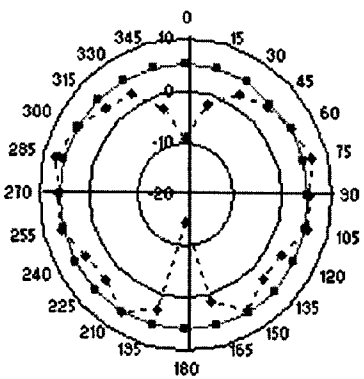
FIG. 3C
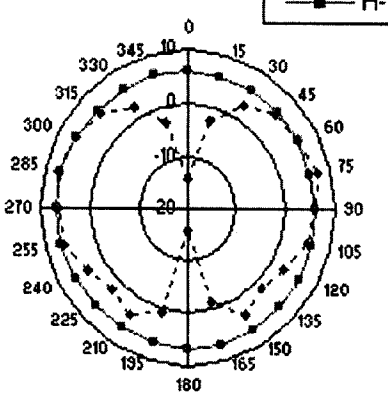
FIG. 3D
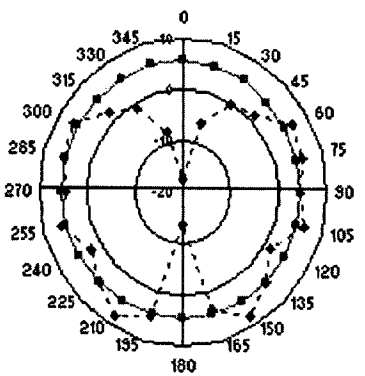
FIG. 3E
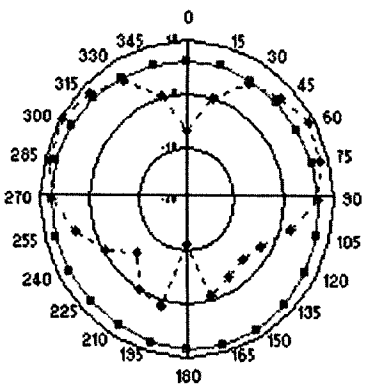
FIG. 3F
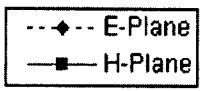

BOW TIE COUPLER

This is a continuation of U.S. patent application Ser. No. 10/797,492, filed Mar. 10, 2004.

BACKGROUND OF THE INVENTION

The present invention relates to radio frequency test equipment, and more particularly, is directed to a coupler for use in a test enclosure and for coupling to test equipment to enable wireless communication with a device under test.

Wireless communication equipment are subject to various standards relating to wireless transmission, including but not limited to power emissions standards and interference standards. The four main cellular frequency bands cover 824 to 960 MHz and 1710 to 1990 MHz. Bluetooth, Wireless LAN (WLAN) and/or global positioning system (GPS) functionality is being added to many wireless products; the center frequencies of these systems are 2450 MHz and 1575 MHz respectively. Such wireless devices, e.g., cellphones, personal digital assistants (PDAs) and smart phones, must be tested prior to sale, to ensure they comply with appropriate standards, and in general, function properly.

FIG. 1A shows a typical radio frequency (RF) testing enclosure. A device under test is placed in an enclosure that contains a coupler for wirelessly coupling between test equipment and the device under test.

Conventional couplers are designed to operate over specific frequency bands. Accordingly, when testing a device designed to operate at several frequency bands, the testing procedure must include switching the coupler for each of the frequency bands being tested. The need to switch between different couplers to test the same device decreases the reliability and repeatability of tests, increases the cost of testing, increases the difficulty of calibrating the tests, and increases the test time.

Thus, there is a need for a wide bandwidth RF coupler, operating in several frequency bands.

SUMMARY OF THE INVENTION

In accordance with an aspect of this invention, there is provided a coupler comprising a first element having a rectangular portion and a tapered portion with a nose, a second element having a rectangular portion and a tapered portion with a nose, a third element disposed between the nose of the first element and the nose of the second element, a matching network for electrically connecting the first, second and third elements.

In accordance with another aspect of this invention, there is provided a bow tie coupler comprising a first element having a tapered nose portion for connecting to a first portion of a signal feed structure, a second element having a tapered nose portion, a third element for connecting to a second portion of the signal feed structure, the third element located between the tapered nose portions of the first and second elements, and a matching network for electrically connecting the first, second and third elements.

In accordance with a further aspect of this invention, there is provided a coupler for use in a radio frequency test chamber, comprising a first element having a tapered nose portion for connecting to a first portion of a signal feed structure, a second element having a tapered nose portion, a third element for connecting to a second portion of the signal feed structure, and a matching network for electrically connecting the first, second and third elements.

It is not intended that the invention be summarized here in its entirety. Rather, further features, aspects and advantages of the invention are set forth in or are apparent from the following description and drawings.

BRIEF DESCRIPTION OF THE DRAWINGS

FIGS. 3A–3F show measured radiation patterns of the coupler of FIG. 2A;

DETAILED DESCRIPTION

Figure 1C:
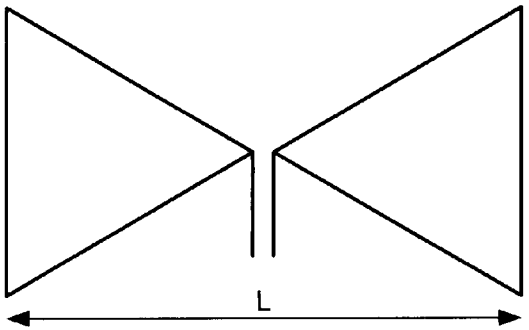
Fig. 1C (Prior Art)
FIG. 1C shows a conventional bow tie antenna.
Figure 1A:
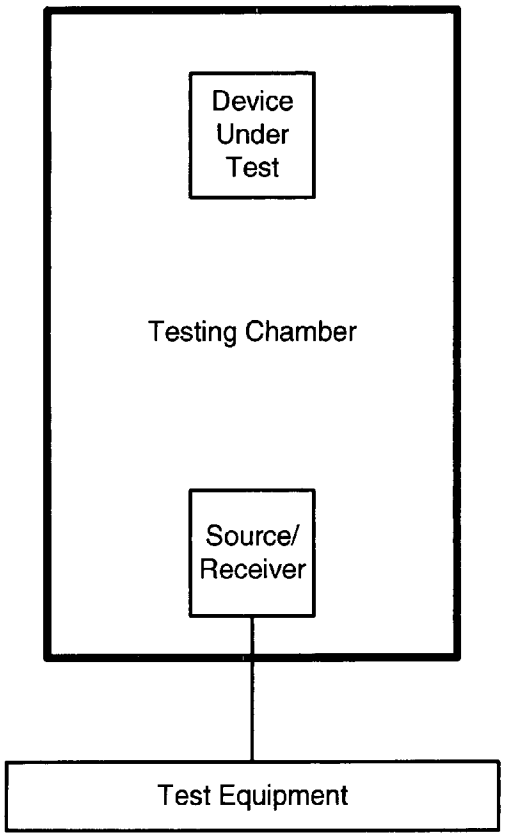
Fig. 1A (Prior Art)
FIG. 1A shows a typical RF enclosure.
Figure 1B:
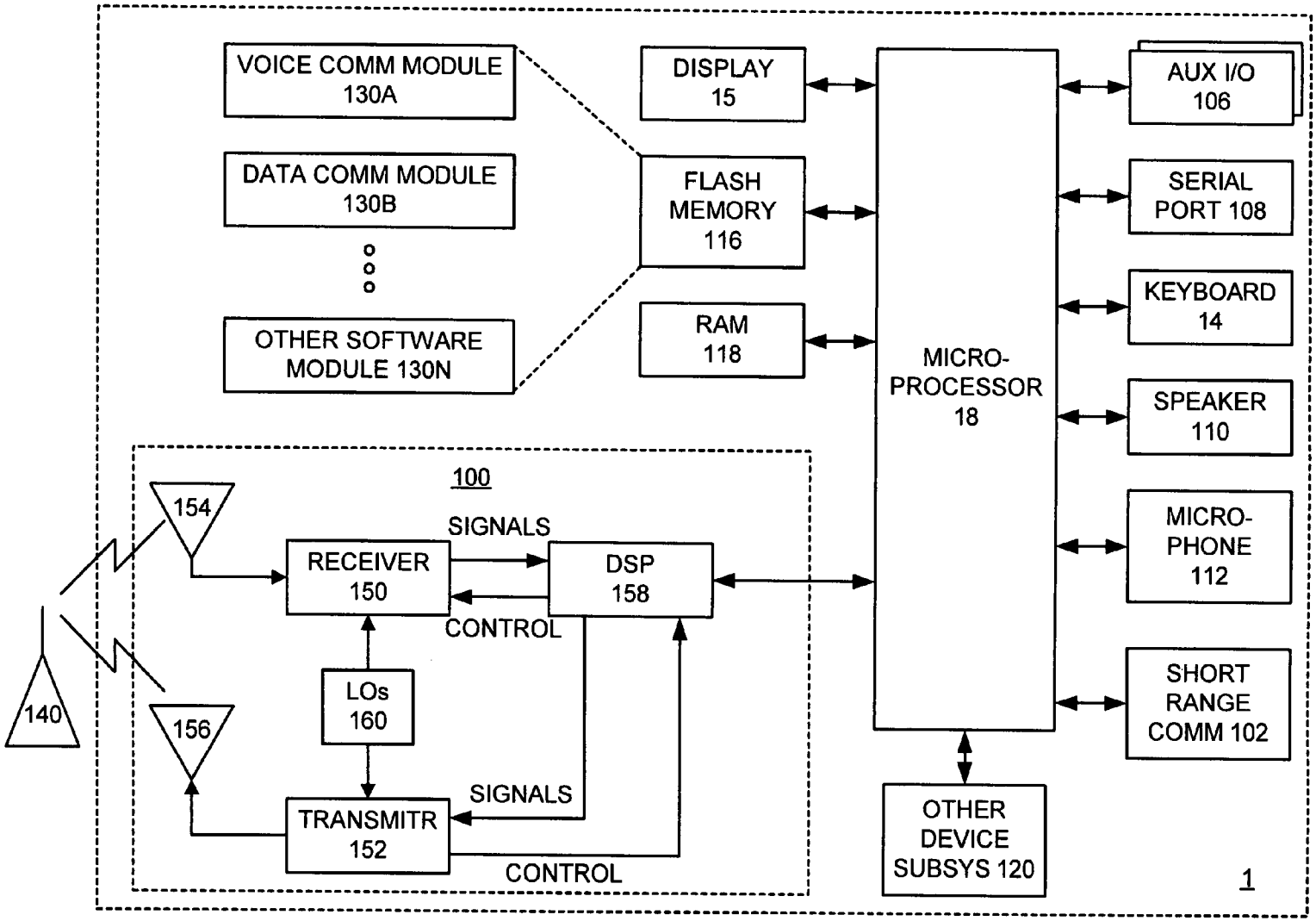
FIG. 1B is a block diagram showing hand-held mobile communication device 1.

FIG. 1B shows hand-held mobile communications device 1, which is an example of a device that may be tested in the enclosure of FIG. 1A.

FIG. 1B shows the conventional operating environment of device 1. Hand-held mobile communication device 1 includes a housing, a keyboard 14 and an output device 16. The output device shown is a display 16, which is preferably a full graphic LCD. Other types of output devices may alternatively be utilized. A processing device 18, which is shown schematically in FIG. 1B, is contained within the housing and is coupled between the keyboard 14 and the display 16. The processing device 18 controls the operation of the display 16, as well as the overall operation of the mobile device 1, in response to actuation of keys on the keyboard 14 by the user.

The housing may be elongated vertically, or may take on other sizes and shapes (including clamshell housing structures). The keyboard may include a mode selection key, or other hardware or software for switching between text entry and telephony entry.

In addition to the processing device 18, other parts of the mobile device 1 are shown schematically in FIG. 41. These include a communications subsystem 100; a short-range communications subsystem; the keyboard 14 and the display 16, along with other input/output devices 106, 108, 11 and 112; as well as memory devices 116, 118 and various other device subsystems 120. The mobile device 1 is preferably a two-way RF communication device having voice and data communication capabilities. In addition, the mobile device 1 preferably has the capability to communicate with other computer systems via the Internet.

Operating system software executed by the processing device 18 is preferably stored in a persistent store, such as a flash memory 116, but may be stored in other types of memory devices, such as a read only memory (ROM) or similar storage element. In addition, system software, specific device applications, or parts thereof, may be temporarily loaded into a volatile store, such as a random access memory (RAM) 118. Communication signals received by the mobile device may also be stored to the RAM 118.

The processing device 18, in addition to its operating system functions, enables execution of software applications 130A–130N on the device 1. A predetermined set of applications that control basic device operations, such as data and voice communications 130A and 130B, may be installed on the device 1 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 140. Preferably, the PIM data items are seamlessly integrated, synchronized and updated via the wireless network 140 with the device user's corresponding data items stored or associated with a host computer system. Communication functions, including data and voice communications, are performed through the communication subsystem 100, and possibly through the short-range communications subsystem. The communication subsystem 100 includes a receiver 150, a transmitter 152, and one or more antennas 154 and 156. In addition, the communication subsystem 100 also includes a processing module, such as a digital signal processor (DSP) 158, and local oscillators (LOs) 160. The specific design and implementation of the communication subsystem 100 is dependent upon the communication network in which the mobile device 1 is intended to operate. For example, a mobile device 1 may include a communication subsystem 100 designed to operate with the Mobitex™, Data TAC™ or General Packet Radio Service (GPRS) mobile data communication networks and also designed to operate with any of a variety of voice communication networks, such as AMPS, TDMA, CDMA, PCS, GSM, etc. Other types of data and voice networks, both separate and integrated, may also be utilized with the mobile device 1.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 1 may send and receive communication signals over the communication network 140. Signals received from the communication network 140 by the antenna 154 are routed to the receiver 150, which provides for signal amplification, frequency down conversion, filtering, channel selection, etc., and may also provide analog to digital conversion. Analog-to-digital conversion of the received signal allows the DSP 158 to perform more complex communication functions, such as demodulation and decoding. In a similar manner, signals to be transmitted to the network 140 are processed (e.g. modulated and encoded) by the DSP 158 and are then provided to the transmitter 152 for digital to analog conversion, frequency up conversion, filtering, amplification and transmission to the communication network 140 (or networks) via the antenna 156.

In addition to processing communication signals, the DSP 158 provides for control of the receiver 150 and the transmitter 152. For example, gains applied to communication signals in the receiver 150 and transmitter 152 may be adaptively controlled through automatic gain control algorithms implemented in the DSP 158.

In a data communication mode, a received signal, such as a text message or web page download, is processed by the communication subsystem 100 and is input to the processing device 18. The received signal is then further processed by the processing device 18 for an output to the display 16, or alternatively to some other auxiliary I/O device 106. A device user may also compose data items, such as e-mail messages, using the keyboard 14 and/or some other auxiliary I/O device 106, such as a touchpad, a rocker switch, a thumb-wheel, or some other type of input device. The composed data items may then be transmitted over the communication network 140 via the communication subsystem 100.

In a voice communication mode, overall operation of the device is substantially similar to the data communication mode, except that received signals are output to a speaker 110, and signals for transmission are generated by a microphone 112. Alternative voice or audio I/O subsystems, such as a voice message recording subsystem, may also be implemented on the device 1. In addition, the display 16 may also be utilized in voice communication mode, for example to display the identity of a calling party, the duration of a voice call, or other voice call related information.

The short-range communications subsystem enables communication between the mobile device 1 and other proximate systems or devices, which need not necessarily be similar devices. For example, the short-range communications subsystem may include an infrared device and associated circuits and components, or a Bluetooth™ communication module to provide for communication with similarly-enabled systems and devices.

The frequency bands of interest for cellular and smart phones are: 850 MHz GSM (824–894 MHz), 900 MHz GSM (880–960 MHz), GPS (1575.42 MHz), DCS (1710–1880 MHz), PCS (1850–1990 MHz), and WLAN (2400–2484 MHz).

A wide bandwidth coupler has two outer elements around a center element. The outer elements are rectangular at their outside portions and each have a tapered nose portion next to the center element. A matching network electrically connects the two outer elements and the center element.

The coupler exhibits better than 2:1 Voltage Standing Wave Ratio (VSWR), stable antenna gain characteristics and a dipole-like radiation pattern over a wide frequency range. In one embodiment of the present invention, the coupler exhibits the above characteristics over a frequency range of 824 to 2484 MHz, that is, all of the frequency bands for cellular and smart phones. Over each frequency band the coupler has very stable antenna gain. These characteristics minimize system error and thus maximize device failure detection during testing. The coupler can be etched easily on printed circuit board material. The wide bandwidth coupler is useful in an RF testing enclosure.

The wide bandwidth coupler eliminates the test time needed to switch the coupler of an RF test chamber, and reduces calibration time. Additionally, the wide bandwidth coupler enables simultaneous testing of multiple bandwidths, and improves the reliability and repeatability of test measurements.

Since couplers wear out sooner if they are switched frequently, the present wide bandwidth coupler should last longer as it will need to be switched less often.

FIG. 1C shows an example of a conventional bow tie antenna having two triangular portions and a signal feed structure connected to the inner vertices of the triangular portions. With the inner vertices having 60° angles, the conventional bow tie antenna could provide a voltage standing wave ratio (VSWR)<2 over a bandwidth of 30% to 40% of the center frequency, when its length L=0.8λ at the center frequency, where λ is the wavelength of a signal being transmitted or received.

Figure 2B:
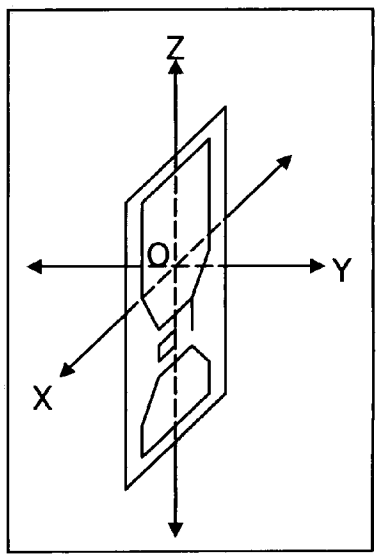
FIGS. 2A–2B show views of a bow tie coupler according to an embodiment of the present invention.
Figure 2A:
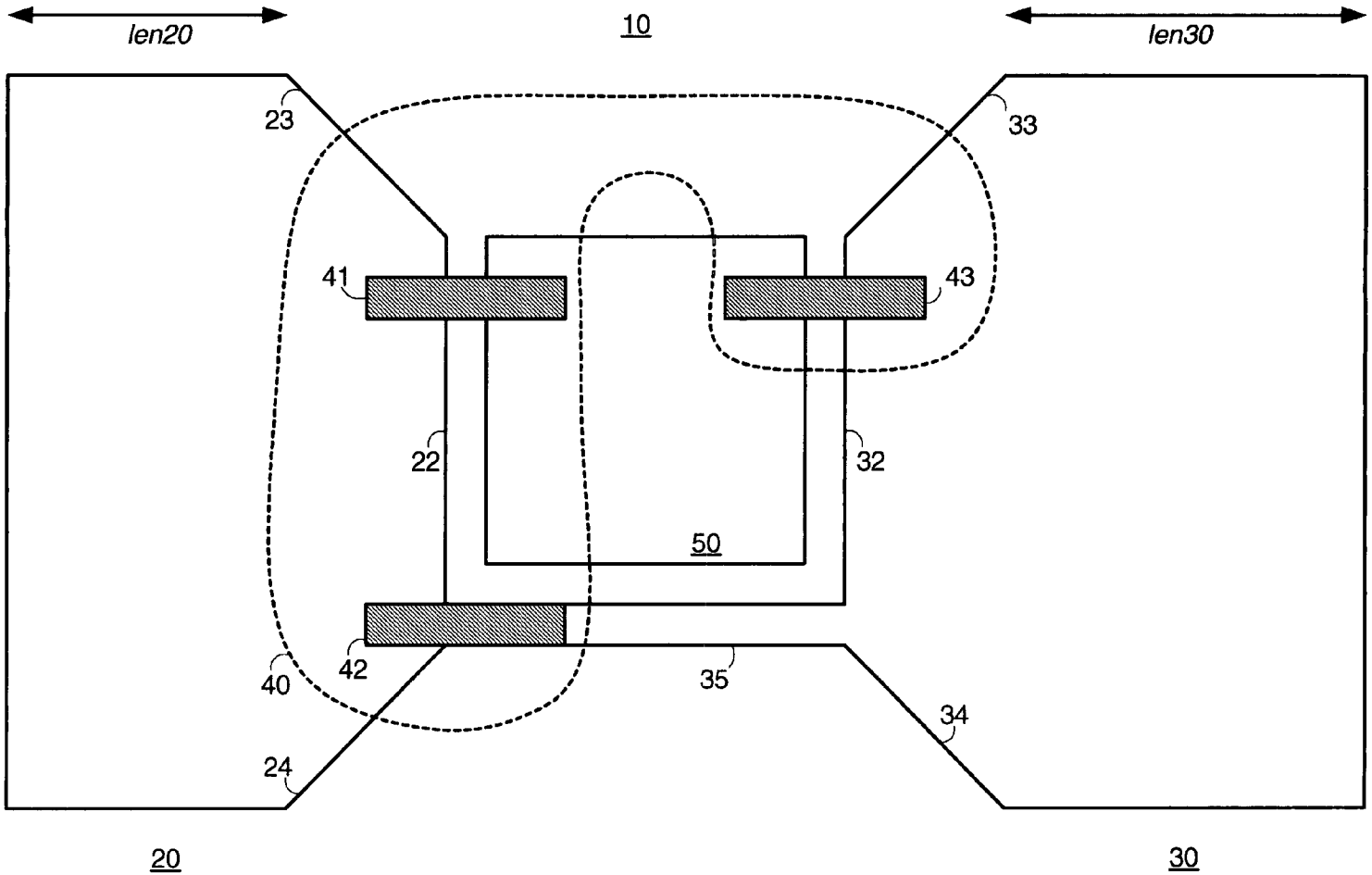

FIG. 2A shows bow tie coupler 10 according to an embodiment of the present invention. Small element 50 is disposed between medium element 20 and large element 30. Matching network 40 electrically connects small element 50, medium element 20 and large element 30.

In one embodiment, bow tie coupler 10 is located on a printed circuit board (PCB) RF substrate, such as a FR4 substrate, with no ground plane opposing the coupler. The elements of bow tie coupler 10 are created on the PCB using a board milling machine or by an etching method. Other methods of manufacturing bow tie coupler 10 will be apparent to those of ordinary skill in the art.

Small element 50 is coupled to the center pin (not shown) of a signal feed structure, such as a coaxial cable or microstrip line, connected to test equipment. Other suitable signal feed structures will be apparent to those of ordinary skill in the art. Small element 50 has a square shape.

Medium element 20 is coupled to the outer sleeve (not shown) of the coaxial cable connected to the test equipment, that is, the signal ground. Medium element 20 has length len20. Medium element 20 has an outer rectangular portion and an inner tapered portion. Sides 23 and 24 taper to edge 22, forming a tapered nose portion.

Bow tie coupler 10 wirelessly receives and transmits with the device under test (not shown), that is, acts as an antenna for converting electromagnetic energy to electrical energy and vice versa. Large element 30 has length len30. Generally, len30 is greater than or equal to len20, with the specific length values chosen in view of the signal frequency range and/or center frequency. However, len30 and len20 may be the same in some embodiments. In one embodiment, len20 is about 20 mm and len30 is about 40 mm. Large element 30 has an outer rectangular portion and an inner tapered portion. Sides 33 and 34 taper to edge 32, forming a tapered nose portion.

Large element 30 has arm 35 which serves to extend element 30 closer to element 20, thereby making it easier to connect matching network 40 between elements 20 and 30.

Matching network 40 comprises matching components 41, 42 and 43. Component 41 electrically connects medium element 20 and small element 50. Component 42 electrically connects medium element 20 and large element 30. Component 43 electrically connects small element 50 and large element 30.

In one embodiment, components 41 and 42 are each a resistor having a resistance of about 190 ohms, and component 43 is an inductor having an inductance of about 1.2 nH. In another embodiment, components 41–43 are each resistors, while in a further embodiment, components 41–43 are each inductors. Other configurations of matching network 40 will be apparent to one of ordinary skill in the art, and may be comprised of combinations of resistors, capacitors and inductors.

FIG. 2B shows a three-dimensional view of bow tie coupler 10.

FIGS. 3A–3F show the radiation patterns of an exemplary bow tie coupler 10, in the E-plane (y-z plane of FIG. 2B) and the H-plane (x-y plane of FIG. 2B), measured in a 20 meter tapered anechoic chamber for various transmit frequencies. The radiation patterns at all of the frequency bands are seen to be dipole-like with good omni-directional H-plane characteristics.

FIG. 3A is for the GSM850 system frequency of 839.6 MHz.

FIG. 3B is for the GSM900 system frequency of 902.4 MHz.

FIG. 3C is for the DCS system frequency of 47.8 MHz.

FIG. 3D is for the PCS system frequency of 1880 MHz.

FIG. 3E is for the GPS system frequency of 1575.42 MHz.

FIG. 3F is for the wireless LAN system frequency of 2450 MHz.

Figure 4:
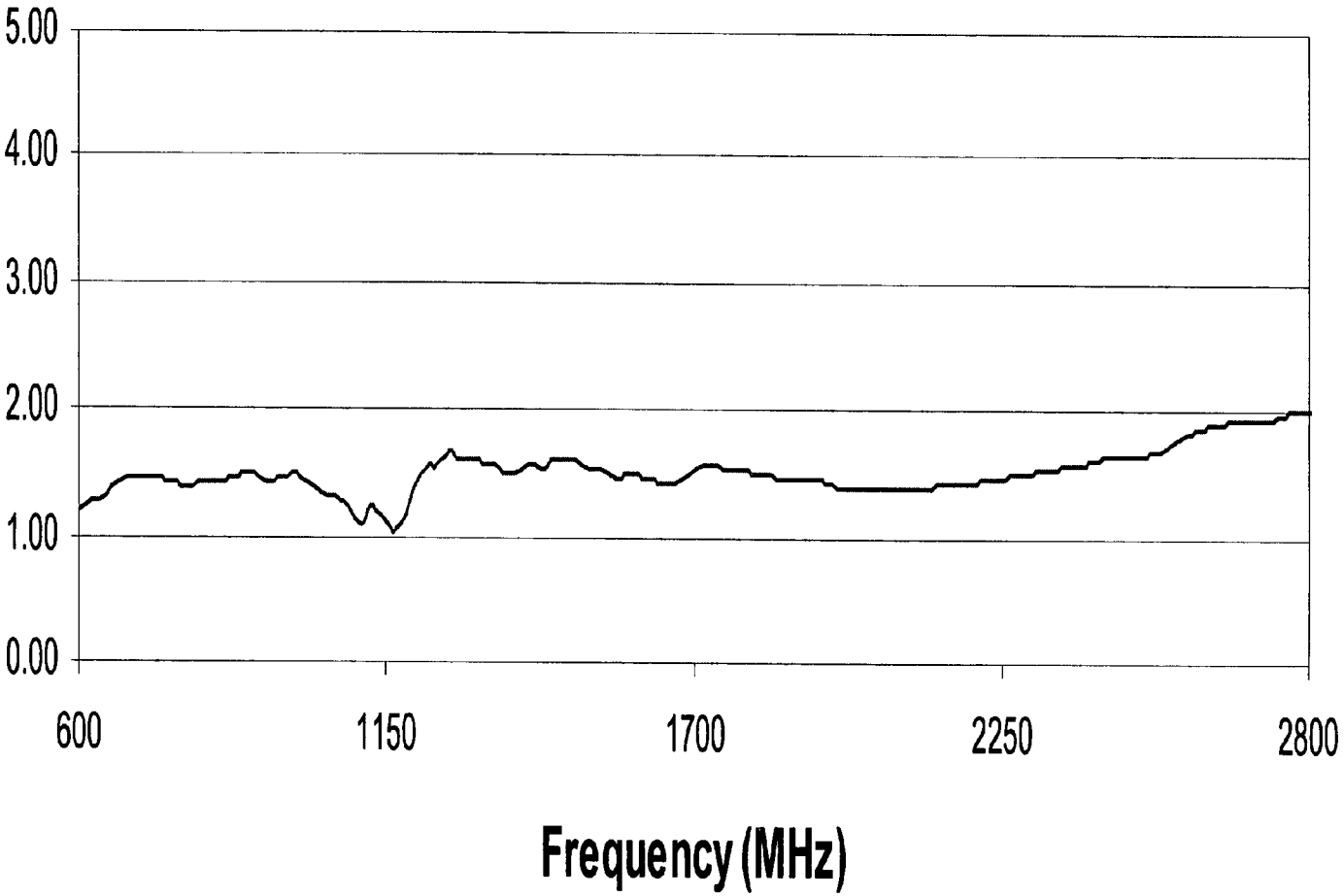
FIG. 4 is a graph showing the Voltage Standing Wave Ratio (VSWR) for the coupler of FIG. 2A.

FIG. 4 is a graph showing the measured VSWR for the exemplary bow tie coupler 10, measured using an Agilent 8753E vector network analyzer. It can be seen that over the frequency range of at least 600 to 2600 MHz the coupler exhibits a substantially flat VSWR curve having a max-min variation of less than 1 and a VSWR better than 2:1.

It will be recalled that a VSWR of 2:1 corresponds to 90% of the input power being converted to output power, and is the RF standard for couplers. A VSWR of 1:1 corresponds to 100% of input power being converted to output power.

Ideally, the VSWR should be better than 2:1 over the entire frequency range of interest.

Figure 5:
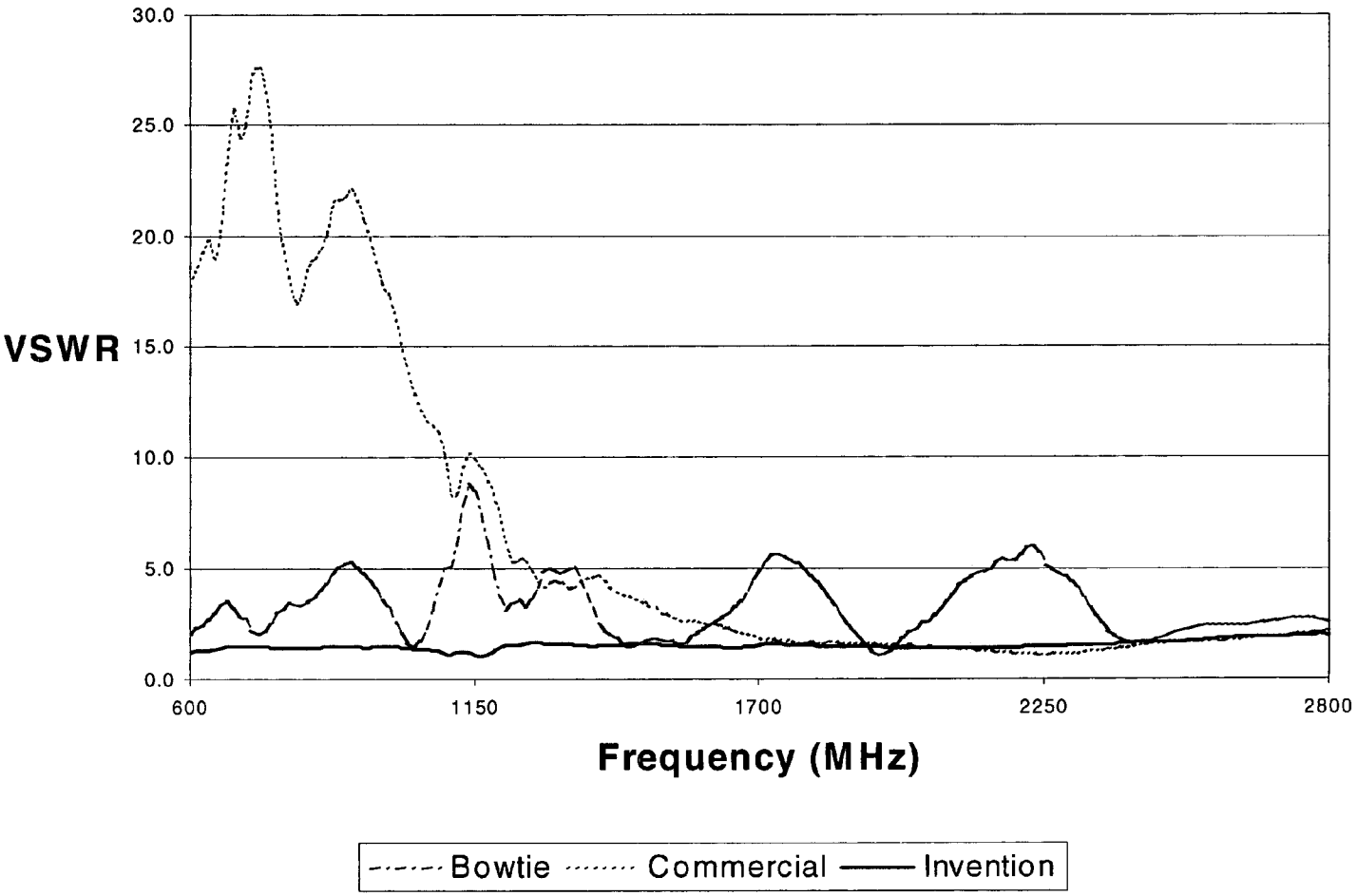
FIG. 5 is a graph showing the VSWRs for several couplers.

FIG. 5 is a graph showing the VSWRs for a conventional bow tie antenna, such as shown in FIG. 1C (dash-dot line), a commercially popular coupler (not shown) (dotted line), and bow tie coupler 10 according to the present invention (solid line). The commercially popular coupler has poor VSWR performance in that its VSWR varies from about 27:1 to close to 1:1 and is not flat. The conventional bow tie antenna has a VSWR varying from about 8:1 to close to 1:. By contrast, bow tie coupler 10 has a VSWR that is generally flat and is better than 2:1.

Figure 6:
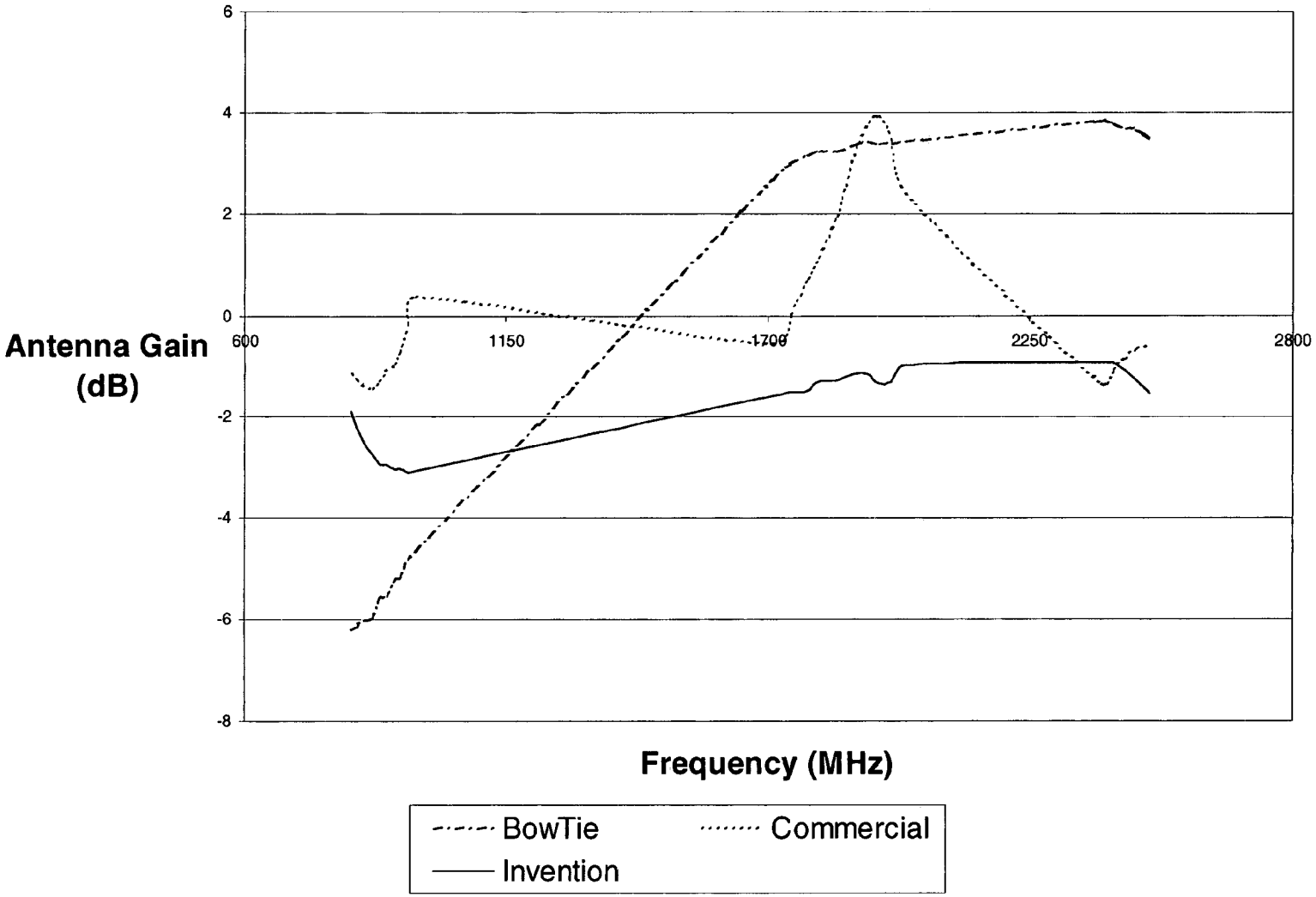
FIG. 6 is a graph showing the antenna gain for several couplers.

FIG. 6 is a graph showing the antenna gain for a conventional bow tie antenna, such as shown in FIG. 1C (dash-dot line), a commercially popular coupler (not shown) (dotted line), and bow tie coupler 10 according to the present invention (solid line). Ideally, the antenna gain should be flat over the entire bandwidth of interest. The commercially popular coupler has a triangular gain curve from about 1700–2400 MHz that has an antenna gain variation (max-min) of about 5 dB. The conventional bow tie antenna has a linearly sloped curve from about 900–1700 MHz with an antenna gain range of about 9 dB. By contrast, bow tie coupler 10 has a generally flat antenna gain curve from about 800–2500 MHz with an antenna gain range of only about 2.5 dB.

Figure 7:
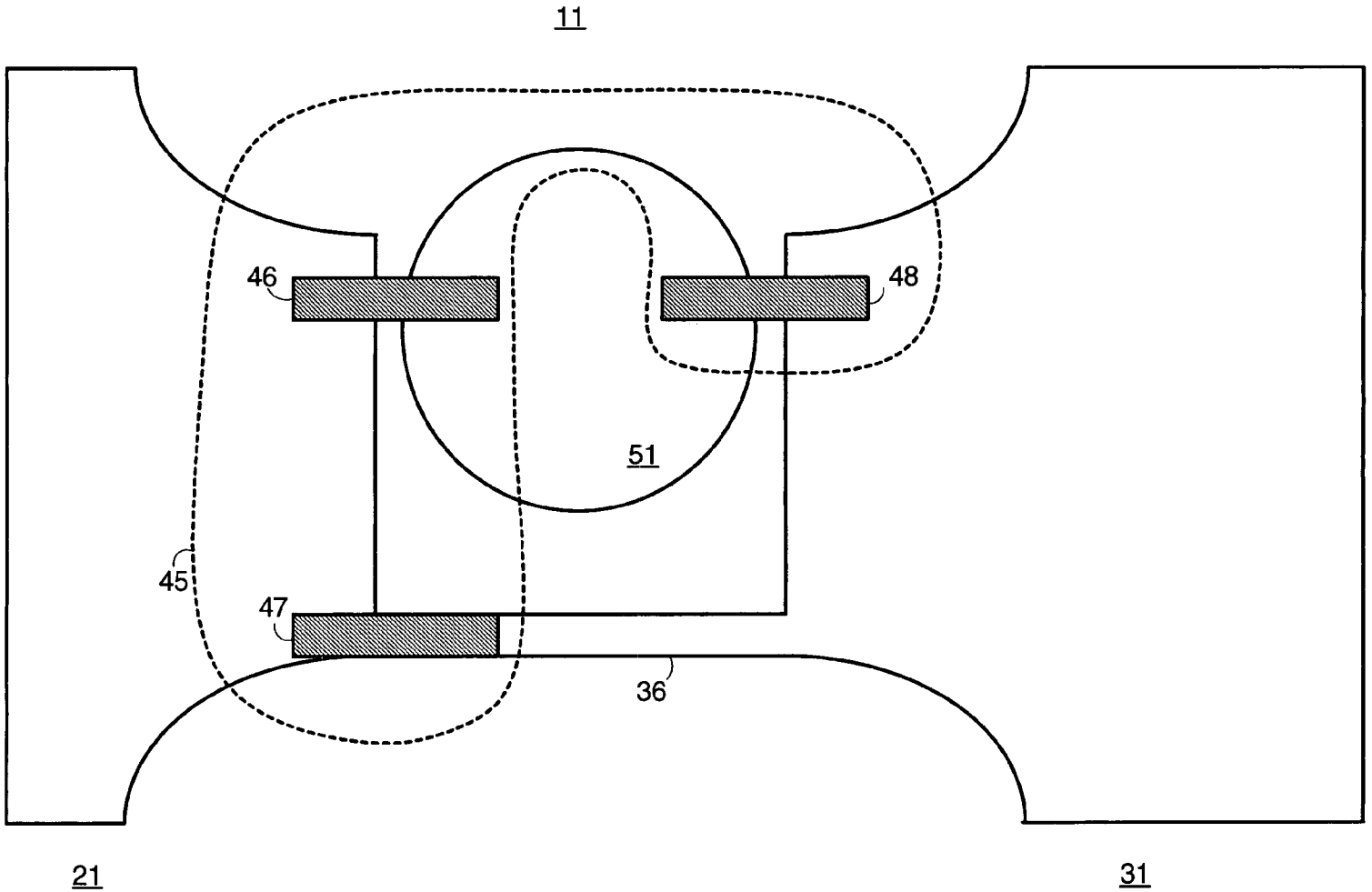
FIG. 7 is a diagram of another bow tie coupler according to an embodiment of the present invention.

An alternate embodiment is shown in FIG. 7, a diagram of bow tie coupler 11, which is generally similar to bow tie coupler 10. For brevity, only the differences will be discussed.

The tapered edges of the noses of medium element 21 and large element 31 of bow tie coupler have a curved or exponential shape, instead of being straight edges as in bow tie coupler 10. Small element 31 of bow tie coupler 11 has a circular shape.

Although an illustrative embodiment of the present invention, and various modifications thereof, have been described in detail herein with reference to the accompanying drawings, it is to be understood that the invention is not limited to this precise embodiment and the described modifications, and that various changes and further modifications may be effected therein by one skilled in the art without departing from the scope or spirit of the invention as defined in the appended claims.

What is claimed is:

1. A bow tie coupler comprising:

a first element having a tapered nose portion, the first element for connecting to a first portion of a signal feed structure, a second element having a tapered nose portion, a third element for connecting to a second portion of the signal feed structure, the third element located between the tapered nose portions of the first and second elements, and a matching network for electrically connecting the first element, the third element and the second element, the matching network having at least two discrete elements selected from the group consisting of resistors, capacitors and inductors, wherein the bow tie coupler has a voltage standing wave ratio (VSWR) of better than 2:1 over a frequency range of at least 600 to 2600 MHz.

2. The bow tie coupler of claim 1, wherein the length of the second element is longer than the length of the first element.

3. The bow tie coupler of claim 1, for use in a radio frequency test chamber.

4. The bow tie coupler of claim 1, wherein the signal feed structure is a coaxial cable, the first portion of the signal feed structure is a ground reference portion of the coaxial cable, and the second portion of the signal feed structure is a center pin of the coaxial cable.

5. A bow tie coupler comprising:

a printed circuit board, a first element having a tapered nose portion, the first element for connecting to a first portion of a signal feed structure, a second element having a tapered nose portion, a third element for connecting to a second portion of the signal feed structure, the third element located between the tapered nose portions of the first and second elements, and a matching network for electrically connecting the first element, the third element and the second element, the matching network having at least two elements etched or milled on the printed circuit boards, wherein the bow tie coupler has a voltage standing wave ratio (VSWR) of better than 2:1 over a frequency range of at least 600 to 2600 MHz.

6. The bow tie coupler of claim 5, wherein the length of the second element is longer than the length of the first element.

7. The bow tie coupler of claim 5, for use in a radio frequency test chamber.

8. The bow tie coupler of claim 5, wherein the signal feed structure is a coaxial cable, the first portion of the signal feed structure is a ground reference portion of the coaxial cable, and the second portion of the signal feed structure is a center pin of the coaxial cable.

9. A coupler for use in a radio frequency test chamber, comprising:

a first element having a tapered nose portion, the first element for connecting to a first portion of a signal feed structure, a second element having a tapered nose portion, a third element for connecting to a second portion of a signal feed structure, and a matching network for electrically connecting the first element, the second element and the third element, wherein the coupler has a generally flat antenna gain curve over a frequency range of at least 800 to 2500 MHz and a max-mm gain variation of no more than about 2.5 dB.

10. The coupler of claim 9, wherein the length of the second element is longer than the length of the first element.

11. The coupler of claim 9 having a voltage standing wave ratio (VSWR) of better than 2:1 over a frequency range of at least 600 to 2600 Mhz.

* * * * *